US009213273B2

(12) United States Patent
Doda et al.

(10) Patent No.: US 9,213,273 B2
(45) Date of Patent: Dec. 15, 2015

(54) IMAGE FORMING APPARATUS

(71) Applicant: CANON KABUSHIKI KAISHA, Tokyo (JP)

(72) Inventors: Kazuhiro Doda, Yokohama (JP); Masaru Shimura, Yokohama (JP); Shigeru Hoashi, Numazu (JP); Kenji Kanari, Numazu (JP); Seiji Saito, Zhongshan (JP); Takashi Shimada, Toyonaka (JP); Takaaki Akamatsu, Yokohama (JP); Michio Uchida, Mishima (JP); Ken Nakagawa, Yokohama (JP); Takamitsu Soda, Mishima (JP); Shuichi Tetsuno, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/255,982

(22) Filed: Apr. 18, 2014

(65) Prior Publication Data

US 2014/0219692 A1 Aug. 7, 2014

Related U.S. Application Data

(63) Continuation of application No. 13/533,210, filed on Jun. 26, 2012, now Pat. No. 8,750,772, which is a (Continued)

(30) Foreign Application Priority Data

| | | |
|---|---|---|
| Nov. 19, 2007 | (JP) | 2007-299055 |
| Feb. 27, 2008 | (JP) | 2008-045517 |
| Nov. 18, 2008 | (JP) | 2008-294169 |

(51) Int. Cl.
*G03G 15/20* (2006.01)
*G03G 15/16* (2006.01)

(52) U.S. Cl.
CPC ..... *G03G 15/1615* (2013.01); *G03G 15/1605* (2013.01); *G03G 15/1685* (2013.01); *G03G 2215/0129* (2013.01)

(58) Field of Classification Search
USPC ..... 399/107, 121, 297, 302, 308, 310–312
See application file for complete search history.

(56) References Cited

U.S. PATENT DOCUMENTS

| | | | |
|---|---|---|---|
| 4,114,536 | A | 9/1978 | Kaneko et al. |
| 5,523,829 | A | 6/1996 | Miyashiro et al. |

(Continued)

FOREIGN PATENT DOCUMENTS

| | | | |
|---|---|---|---|
| CN | 1128778 | A | 8/1996 |
| CN | 1229199 | A | 9/1999 |

(Continued)

OTHER PUBLICATIONS

International Search Report and Written Opinion dated Jan. 6, 2009, in International Application No. PCT/JP2008/071481.

(Continued)

*Primary Examiner* — Hoan Tran

(74) *Attorney, Agent, or Firm* — Fitzpatrick, Cella, Harper & Scinto

(57) ABSTRACT

An image forming apparatus includes: an image bearing member for bearing a toner image; a belt for conveying the toner image; and a transfer device for rubbing the belt, and a surface of the transfer device, which is brought into contact with the belt includes linear concave portions or linear convex portions. The image forming apparatus of the present invention prevents a friction force between the belt and the transfer device rubbing the belt from increasing and brings a transfer member into a stable contact with the belt for conveying the toner image, thereby suppressing increase in drive torque of the belt which rubs the transfer device and suppressing occurrence of image failure.

9 Claims, 12 Drawing Sheets

Related U.S. Application Data continuation of application No. 13/328,637, filed on Dec. 16, 2011, now Pat. No. 8,238,807, which is a continuation of application No. 12/425,086, filed on Apr. 16, 2009, now Pat. No. 8,165,512, which is a continuation of application No. PCT/JP2008/071481, filed on Nov. 19, 2008.

(56) References Cited

U.S. PATENT DOCUMENTS

| | | | | |
|---|---|---|---|---|
| 5,697,033 | A | 12/1997 | Ichikawa et al. | |
| 5,767,171 | A | 6/1998 | Matsubara et al. | |
| 5,893,665 | A | 4/1999 | Ichikawa et al. | |
| 5,918,096 | A | 6/1999 | Sano et al. | |
| 6,035,158 | A | 3/2000 | Asakura et al. | |
| 6,097,920 | A | 8/2000 | Hara et al. | |
| 6,133,927 | A | 10/2000 | Arai et al. | |
| 6,397,033 | B1 * | 5/2002 | Todome | 399/303 |
| 6,643,487 | B1 | 11/2003 | Shimmura | |
| 6,668,149 | B2 | 12/2003 | Omata et al. | |
| 6,711,367 | B2 | 3/2004 | Saito et al. | |
| 6,920,299 | B2 | 7/2005 | Shimura et al. | |
| 7,133,631 | B2 | 11/2006 | Ito et al. | |
| 7,409,182 | B2 | 8/2008 | Ishii | |
| 7,486,904 | B2 | 2/2009 | Sato et al. | |
| 8,068,775 | B2 | 11/2011 | Inaba et al. | |
| 8,165,512 | B2 * | 4/2012 | Doda et al. | 399/310 |
| 8,238,807 | B2 | 8/2012 | Doda et al. | |
| 8,750,772 | B2 | 6/2014 | Doda et al. | |
| 2008/0253813 | A1 | 10/2008 | Inaba et al. | |
| 2009/0196663 | A1 | 8/2009 | Yasumaru et al. | |
| 2009/0202281 | A1 | 8/2009 | Doda et al. | |
| 2012/0087700 | A1 | 4/2012 | Doda et al. | |
| 2012/0269557 | A1 | 10/2012 | Doda et al. | |

FOREIGN PATENT DOCUMENTS

| | | | |
|---|---|---|---|
| JP | 5-127546 | A | 5/1993 |
| JP | 8-234602 | A | 9/1996 |
| JP | 9-120218 | A | 5/1997 |
| JP | 9-230709 | A | 9/1997 |
| JP | H10-186892 | A | 7/1998 |
| JP | H11-198451 | A | 7/1999 |
| JP | 11-219048 | A | 8/1999 |
| JP | 2000-181253 | A | 6/2000 |
| JP | 2001-209058 | A | 8/2001 |
| JP | 2001-209258 | A | 8/2001 |
| JP | 2006-47769 | A | 2/2006 |
| JP | 2007-156455 | A | 6/2007 |
| JP | 2009-230102 | A | 10/2009 |
| WO | 2007/055415 | A1 | 5/2007 |

OTHER PUBLICATIONS

Notification Concerning Transmittal of International Preliminary Report on Patentability and International Preliminary Report on Patentability mailed Jun. 3, 2010.

Notification of Transmittal of Translation of the International Preliminary Report on Patentability and International Preliminary Report on Patentability mailed Jun. 17, 2010, in International Application No. PCT/JP2008/071481.

Notification of First Office Action dated Jul. 25, 2011, in Chinese Application No. 200880116260.8.

Notification of Reasons for Refusal dated Jul. 29, 2011, in Korean Application No. 10-2010-7012861.

Office Action dated Dec. 13, 2011, in Japanese Application No. 2008-294169.

Communication dated Dec. 14, 2011, forwarding a European Search Report dated Dec. 5, 2011, in European Application No. 08851297.5-2209/2224290 PCT/JP2008/071481.

Notification of Reasons for Refusal issued Oct. 30, 2012, in Japanese Application No. 2012-151613.

Chinese Office Action dated Jul. 28, 2015, in related Chinese Patent Application No. 201410001871.5 (with English translation).

* cited by examiner

FIG. 6

| | EMBODIMENT 1 | COMPARATIVE EXAMPLE 1 | COMPARATIVE EXAMPLE 2 |
|---|---|---|---|
| FRICTION COEFFICIENT | 0.4 | 0.21 | 0.2 |
| ITB DRIVE TORQUE [N·m] | 0.28 | 0.14 | 0.14 |

FIG. 7

| PRIMARY TRANSFER CURRENT [μA] | EMBODIMENT 1 | COMPARATIVE EXAMPLE 1 | COMPARATIVE EXAMPLE 2 |
|---|---|---|---|
| 1.0 | △ | – | × |
| 2.0 | ○△ | – | △ |
| 3.0 | ○ | – | ○ |
| 4.0 | ○ | – | ○ |
| 5.0 | ○ | – | ○ |

PRIOR ART

IMAGE FORMING APPARATUS

This application is a continuation of International Application No. PCT/JP2008/071481, filed on Nov. 19, 2008, which claims the benefit of Japanese Patent Applications No. 2007-299055 filed on Nov. 19, 2007, No. 2008-045517 filed on Feb. 27, 2008, and No. 2008-294169 filed on Nov. 18, 2008.

BACKGROUND OF THE INVENTION

1. Field of the Invention

The present invention relates to an image forming apparatus including a transfer device for transferring a toner image from an image bearing member toward a belt, and more particularly, to an apparatus in which a transfer device rubs a belt.

2. Description of the Related Art

Conventionally, in an electrophotographic image forming apparatus, there is known a configuration in which a toner image borne by a photosensitive drum as an image bearing member is electrostatically transferred to an intermediate transfer belt by a transfer device to which a voltage of an opposite polarity to that of a charged toner is applied. There is also known a configuration in which a toner image is electrostatically transferred to a recording material borne by a recording material bearing belt. Such transfer device as described above include a transfer device rotating together with a belt, such as a transfer roller which is connected to a high voltage power supply circuit and which is disposed at a location opposed to a photosensitive drum via the belt.

FIG. 16 illustrates an exemplary nip configuration formed between a photosensitive drum and a transfer roller which are opposed to each other with a belt sandwiched therebetween. When a transfer roller is used as a transfer device, there may be cases in which, because the transfer roller rotates, a width of a contact region between the belt and the transfer roller in a movement direction of the belt (so-called transfer nip) changes. This is because the diameter of the transfer roller is not uniform in a strict sense. Therefore, when a toner image is transferred from the photosensitive drum, a current which passes from the transfer roller to the photosensitive drum may change to cause unevenness in transfer.

As a measure against these, Japanese Patent Application Laid-Open No. H05-127546 proposes a configuration in which a brush is used as a transfer member that does not rotate. In such a configuration using a brush, each fiber forming the brush can be independently brought into contact with the belt.

Japanese Patent Application Laid-Open No. H09-120218 discloses a configuration which does not include a belt but uses as a transfer device a film supported by a support member. Further, Japanese Patent Application Laid-Open No. H09-230709 discloses a configuration in which a blade supported by a support member is used as a transfer device.

However, the brush is not brought into contact in a sheet-like manner, and hence unevenness in transfer is liable to occur. Further, with regard to the above-mentioned conventional film as a transfer device which is brought into contact with a rotating belt, a friction force on a contact surface between the transfer device and the belt becomes larger. Therefore, drive torque of the belt with respect to the transfer device becomes larger, and unusual noise may be generated because the transfer device rubs the belt. Further, the friction of a transfer device which rubs the belt is larger than the friction of a rotating transfer roller with a belt, and hence the drive torque for rotating the belt becomes larger, and a load to a drive motor and the like becomes higher.

SUMMARY OF THE INVENTION

An object of the present invention is to suppress an increase in friction force between a belt and a transfer member and to bring a transfer device into stable contact with the belt for conveying a toner image, thereby suppressing an increase in drive torque of the belt which rubs the transfer device.

Another object of the present invention is to provide an image forming apparatus comprising: an image bearing member for bearing a toner image; a belt for conveying the toner image; and a transfer device having a surface for rubbing the belt, the toner image being transferred from the image bearing member toward the belt by the transfer device, wherein: the surface of the transfer device, which is brought into contact with the belt, comprises linear concave portions; and a direction of the linear concave portions intersects a conveyance direction of the belt.

Further objects of the present invention become apparent from the following description and the attached drawings.

BRIEF DESCRIPTION OF THE DRAWINGS

FIG. 6 is a table illustrating results of evaluations of the embodiment and the comparative examples.

FIG. 7 is a table illustrating results of evaluations of the embodiment and the comparative examples.

DESCRIPTION OF THE EMBODIMENTS

Exemplary embodiments of the present invention are described in detail by way of example in the following with reference to the drawings. It is to be noted that the dimensions, materials, shapes, relative positions, and the like of components described in the following embodiments should be appropriately changed depending on the configuration and various conditions of an apparatus to which the present invention is applied. Therefore, unless otherwise specified, the scope of the present invention is not intended to be limited thereto.

<Embodiment 1 >

Figure 1:
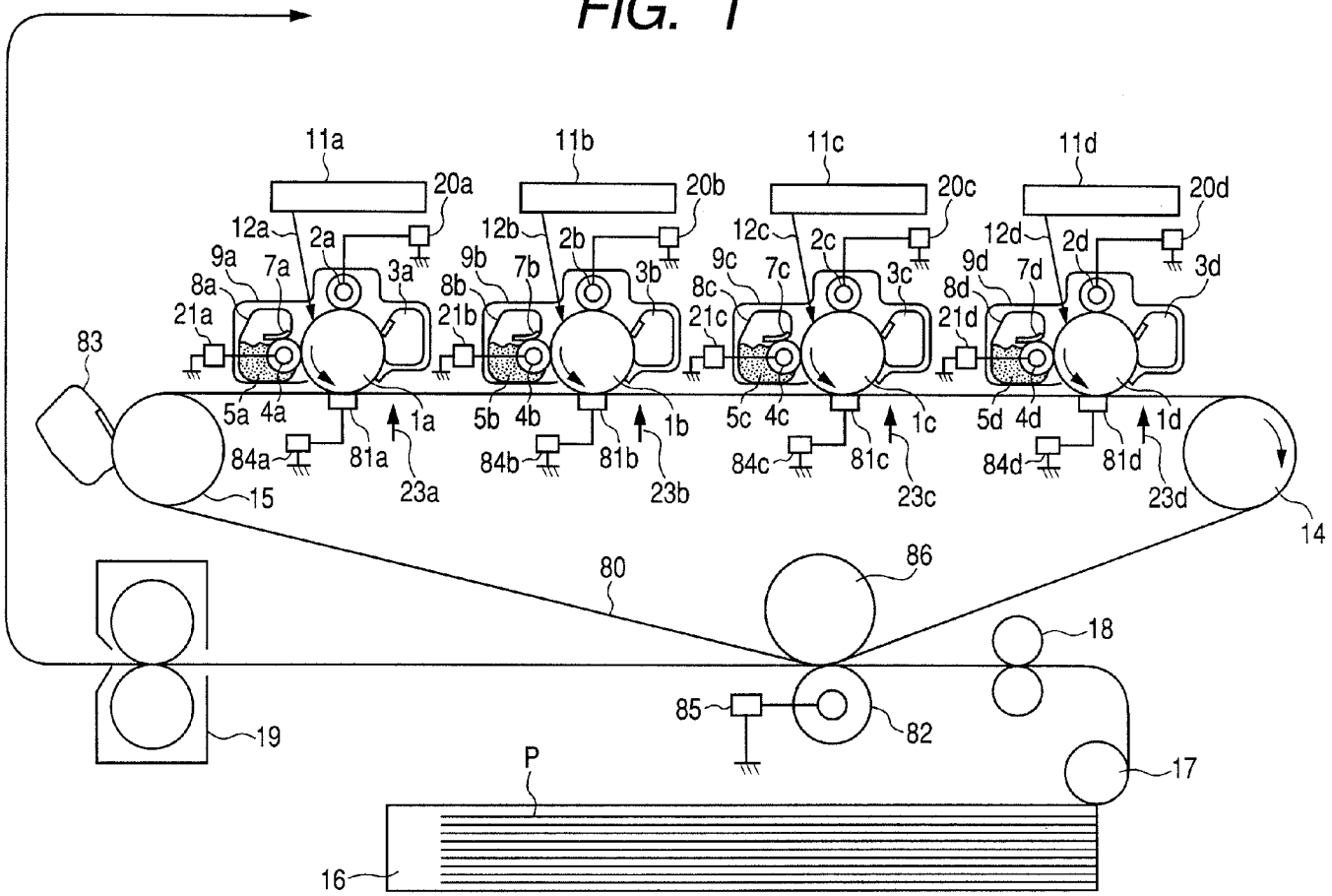
FIG. 1 is a schematic sectional view illustrating an overall configuration of an image forming apparatus as an embodiment of the present invention.

Embodiment 1 of the present invention is now described with reference to the drawings. FIG. 1 is a schematic view illustrating an overall configuration of an image forming apparatus. Here, as the image forming apparatus of Embodiment 1, a color printer including multiple image forming portions (image forming stations) is described by way of example.

The image forming apparatus illustrated in FIG. 1 includes four image forming stations which can form toner images of different colors. Here, a first image forming station is for yellow (a), a second image forming station is for magenta (b), a third image forming station is for cyan (c), and a fourth image forming station is for black (d).

Process cartridges 9*a*, 9*b*, 9*c*, and 9*d* corresponding to the respective colors are detachably attached to the respective image forming stations. The process cartridges 9*a*, 9*b*, 9*c*, and 9*d* have substantially the same configuration. Each of the process cartridges 9 includes a photosensitive drum 1 as an image bearing member, a charging roller 2 as a charge device, a developing device 8 as developing means, and a cleaning unit 3 as cleaning means. Each of the developing devices 8 includes a developing sleeve 4 and a toner application blade 7, and toner (here, a nonmagnetic one-component developer) 5 is housed therein. Each of the charging rollers 2 is connected to a charging bias power supply circuit 20 as means for supplying voltage to the charging roller 2. Similarly, each of the developing sleeves 4 is connected to a development power supply circuit 21 as means for supplying voltage to the developing sleeve 4.

Further, an optical unit (exposing means) 11 for irradiating the photosensitive drum 1 with laser light 12 corresponding to image information is provided in each of the image forming stations.

The image forming apparatus also includes an intermediate transfer belt 80 which is an endless belt. The intermediate transfer belt 80 is disposed so as to be able to abut against all four photosensitive drums 1*a*, 1*b*, 1*c*, and 1*d*. The intermediate transfer belt 80 is supported by three rollers, i.e., a secondary transfer opposing roller 86, a drive roller 14, and a tension roller 15 as looping members, such that appropriate tension is maintained. By driving the drive roller 14, the intermediate transfer belt 80 can move in a forward direction at a substantially constant speed with respect to the photosensitive drums 1*a*, 1*b*, 1*c*, and 1*d*.

Primary transfer members 81 (81*a*, 81*b*, 81*c*, and 81*d*) are disposed at locations opposed to the photosensitive drums 1 (1*a*, 1*b*, 1*c*, and 1*d*), respectively, via the intermediate transfer belt 80. Each of the primary transfer members 81 is connected to a primary transfer power supply circuit 84 (84*a*, 84*b*, 84*c*, or 84*d*) as means for supplying voltage to each of the primary transfer members 81 such that a voltage having a polarity opposite to that of the charged toner is applied from each of the primary transfer power supply circuits 84. The intermediate transfer belt 80 moves between the photosensitive drums 1 and the primary transfer members 81. In each of the primary transfer regions in which the photosensitive drum 1 and the primary transfer member 81 are opposed to each other, a toner image formed on each of the photosensitive drums 1 is transferred in succession by each of the primary transfer members 81 onto an outer surface of the intermediate transfer belt 80 such that the toner images are overlaid on one another.

It is to be noted that, here, as the intermediate transfer belt 80, PVDF having a thickness of 100 μm and a volume resistivity of 1010Ωcm is used. As the drive roller 14, a core formed of Al which is covered with EPDM rubber having carbon dispersed therein as a conductor, a resistance of 104Ω, and a material thickness of 1.0 mm is used. The outer diameter of the drive roller 14 is 25 mm. As the tension roller 15, a metal bar formed of Al having an outer diameter of 25 mm is used. The tension thereof on one side is 19.6 N and the total pressure thereof is 39.2 N. As a secondary transfer opposing roller 82, a core formed of Al which is covered with EPDM rubber having carbon dispersed therein as a conductor, a resistance of 104Ω, and a material thickness of 1.5 mm is used. The outer diameter of the secondary transfer roller 82 is 25 mm.

Transfer residual toner which remains on the intermediate transfer belt 80 after the secondary transfer and paper powder generated by conveying a recording material P are removed and collected from the surface of the intermediate transfer belt 80 by belt cleaning means 83 which abuts against the intermediate transfer belt 80. It is to be noted that, here, as the belt cleaning means 83, an elastic cleaning blade formed of polyurethane rubber or the like is used.

The image forming apparatus further includes a feed roller 17 for feeding one by one the recording material P from a feed cassette 16 and registration rollers 18 for conveying the recording material P to a secondary transfer region in which the roller 86 and the secondary transfer roller 82 are opposed to each other via the belt 80. It is to be noted that the secondary transfer roller 82 is connected to a secondary transfer power supply 85. A fixing unit 19 includes a fixing roller and a pressure roller, and, by applying heat and pressure to the toner image on the recording material P, fixes the toner image on the recording material P.

It is to be noted that, here, as the secondary transfer roller 86, a nickel-plated steel bar having an outer diameter of 8 mm which is covered with an NBR foamed sponge body having an adjusted resistance of 108Ω and an adjusted thickness of 5 mm is used. The outer diameter of the secondary transfer opposing roller 86 is 18 mm. Further, the secondary transfer roller 86 is disposed so as to abut against the intermediate transfer belt 80 with a linear pressure of about 5 to 15 g/cm and to rotate in a forward direction with respect to the movement direction of the intermediate transfer belt 80 at a substantially constant speed.

Next, image forming operation is described. When image forming operation starts, the photosensitive drums 1*a* to 1*d*, the intermediate transfer belt 80, and the like starts rotating at a predetermined process speed in a direction illustrated by an arrow. First, at the first image forming station, the photosensitive drum 1*a* is charged uniformly to the negative polarity by the power supply circuit 20*a* which supplies voltage to the charging roller 2*a*. Then, an electrostatic latent image is formed on the photosensitive drum 1*a* by the laser light 12*a* applied from the optical unit 11*a*.

The toner 5*a* in the developing device 8*a* is charged to the negative polarity by the toner application blade 7*a* and is applied to the developing sleeve 4*a*. Bias is supplied to the developing sleeve 4*a* by the development bias power supply 21*a*. When the electrostatic latent image formed on the photosensitive drum 1*a* reaches the developing sleeve 4*a*, the electrostatic latent image is visualized by the toner of the negative polarity, and a toner image of the first color (here, yellow) is formed on the photosensitive drum 1*a*.

The toner image formed on the photosensitive drum 1*a* is primarily transferred onto the intermediate transfer belt 80 by the action of the primary transfer member 81*a*. Toner which remains on the surface of the photosensitive drum 1*a* is cleaned off the drum after the primary transfer by the cleaning unit 3*a* to prepare for the next image formation.

It is to be noted that, with regard to the second to fourth image forming stations for magenta, cyan, and black, an image forming process similar to that with regard to the first image forming station for yellow described above is performed. More specifically, toner images of the respective colors are formed on the respective photosensitive drums, the toner images of the respective colors are transferred onto the intermediate transfer belt 80 so as to be overlaid on one another, and a multi-image is formed on the intermediate transfer belt 80.

On the other hand, in synchronization with the image forming process described above, the recording material P housed in the feed cassette 16 is fed one by one by the feed roller 17, and is conveyed to the registration rollers 18. The recording material P is conveyed to an abutting portion (secondary transfer region) formed by the intermediate transfer belt 80 and the secondary transfer roller 86 by the registration rollers 18 in synchronization with the toner image on the intermediate transfer belt 80. Then, by the secondary transfer roller 86 to which voltage of the opposite polarity to that of the toner is applied by the secondary transfer power supply circuit 85, the multi-toner image of the four colors borne on the intermediate transfer belt 80 is secondarily transferred onto the recording material P in a collective manner. After that, by applying heat and pressure by the fixing unit 19 to the toner image on the recording material P, the toner image is fixed on the recording material P. The recording material P having the toner image fixed thereon is discharged to the outside of the image forming apparatus as an image-formed article (print or copy).

Figure 2A:
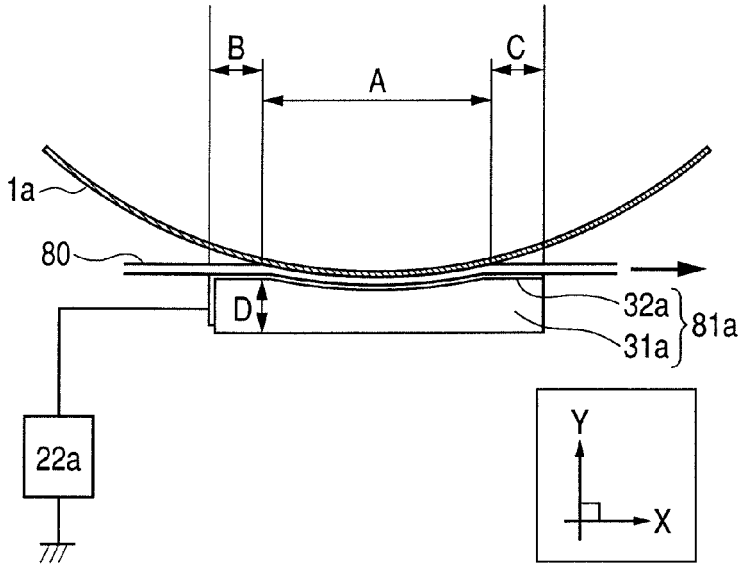
FIGS. 2A and 2B are explanatory views of a primary transfer portion used in Embodiment 1.
Figure 2B:
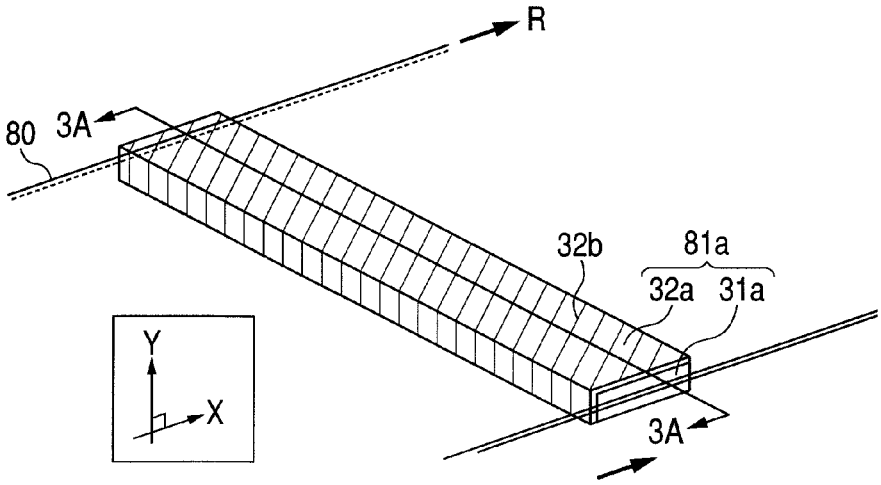

Here, the configuration of a primary transfer portion according to Embodiment 1 is described with reference to FIGS. 2A and 2B. FIGS. 2A and 2B illustrate the configuration of the primary transfer portion according to Embodiment 1. FIG. 2A is an enlarged sectional view illustrating the relationship among the primary transfer member, the intermediate transfer belt, and the photosensitive drum, which form a nip, and FIG. 2B is a perspective view of the primary transfer member.

It is to be noted that the configurations of the first to fourth image forming portions are similar to one another, and hence in the following description, the relationship among the primary transfer member, the intermediate transfer belt, and the photosensitive drum in the first image forming portion is described by way of example and description of the configurations of other image forming portions are omitted here.

The primary transfer member 81*a* includes an urging member 31*a* supported by a support member (not shown) at a location opposed to the photosensitive drum 1*a* with the intermediate transfer belt 80 sandwiched therebetween, and a sheet member 32*a* sandwiched between the intermediate transfer belt 80 and the urging member 31*a* and brought into contact with the intermediate transfer belt 80. The sheet member 32*a* rubs an inner surface of the intermediate transfer belt in a sheet-like manner on its surface, and the urging member 31*a* urges the sheet member 32*a* toward the intermediate transfer belt. While the belt is moving, a contact surface of the transfer device with the intermediate transfer belt is substantially stationary, which is different from the case of the transfer roller. The sheet member 32*a* includes linear convex portions or linear concave portions provided on its surface brought into contact with the inner surface of the belt 80. For example, as illustrated in FIGS. 2A and 2B, the sheet member 32*a* includes multiple linear convex portions 32*b* on its surface brought into contact with the intermediate transfer belt 80. Further, the sheet member 32*a* is brought into contact with the intermediate transfer belt 80 such that the linear convex portions intersect the movement direction of the intermediate transfer belt 80. Here, the linear convex portions 32*b* on the surface of the sheet member 32*a* intersect obliquely the conveyance direction of the belt (in a direction illustrated by an arrow R) (in FIG. 2B, so as to form an angle of 30°). It is to be noted that FIG. 2B schematically illustrates the linear convex portions 32*b* for the sake of easy understanding. Further, there is a linear concave portion between linear convex portions. By forming the linear convex portions or the linear concave portions on the contact surface, the contact area between the surface of the sheet member 32*a* and the inner surface of the intermediate transfer belt 80 becomes smaller. This decreases the friction co-efficient between the sheet member 32*a* and the belt 80, and thus, adverse effect on the driving of the intermediate transfer belt 80 is less liable to occur, and also, stress on the sheet member 32 is alleviated. Further, in this embodiment, the urging member is adapted to press the sheet member in the transfer, and hence uniform contact between the sheet member and the intermediate transfer belt 80 can be secured with more reliability.

Figure 3A:
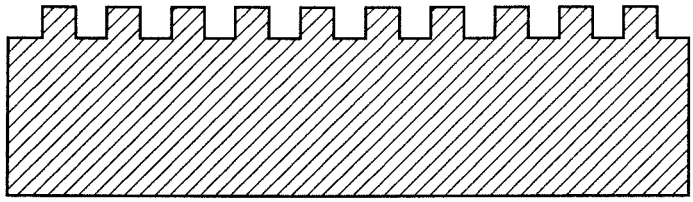
FIGS. 3A, 3B, and 3C are explanatory views of other configurations of the primary transfer portion used in Embodiment 1.
Figure 3B:
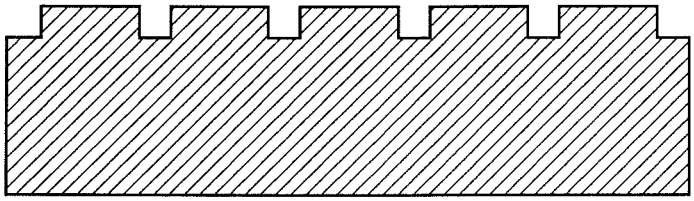
Figure 3C:
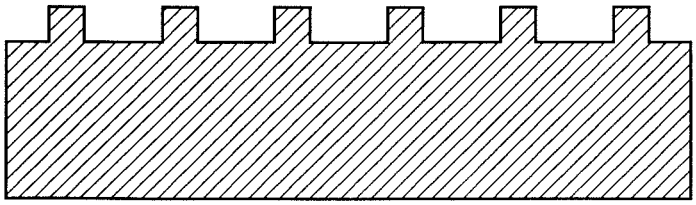

FIG. 3A is a sectional view taken along the line 3A-3A of FIG. 2B. The relationship between the linear concave portions and the linear convex portions may be, other than the one illustrated in FIG. 3A, as illustrated in FIG. 3B or FIG. 3C, in which one of the concave portions and the convex portions are larger in a longitudinal direction than the other of the concave portions and the convex portions.

More specifically, as the elastic member 31*a*, a polyurethane foamed sponge-like elastic body having a shape of a substantially rectangular parallelepiped, a thickness of 5 mm, a width of 5 mm, and a length of 230 mm is used. The elastic member 31*a* is 20° ASKER C at a load of 500 gf. It is to be noted that, here, foamed polyurethane is used as the elastic member 31*a*, but a rubber material such as epichlorohydrin rubber, NBR, or EPDM, a microcell polymer sheet PORON, or the like may also be used.

As the sheet member 32*a*, an ultra high molecular weight conductive polyethylene sheet having a thickness of 200 μm is used. The resistance of the sheet member measured by a general-purpose measuring instrument (Loresta-AP (MCP-T400) manufactured by Mitsubishi Chemical Corporation) was $10^5\Omega$ (at a room temperature of 23° C. and a humidity of 50% during the measurement). Further, the surface friction co-efficient of the sheet member was about 0.2. It is to be noted that the friction co-efficient used here is a value obtained when a portable tribometer (HEIDON TRIBOGER Type 94i manufactured by SHINTO Scientific Co., Ltd.) was used.

Here, a method of forming the sheet member is briefly described. A material is compressed into ultra high molecular weight PE, and the further compressed block-like mass is processed into sheets. The processing into sheets is carried out by rotating the block-like mass, putting a blade on the block-like mass, and shaving the block-like mass into sheets. In the method of processing into sheets described above, thin lines of blade traces, which are linear concave portions or linear convex portions, are produced. The sheet member used in Embodiment 1 has the thin lines of blade traces which are linear concave portions or linear convex portions produced on both a front surface and a rear surface thereof. The thin lines of blade traces can produce a considerable number of linear concave portions or linear convex portions of 10 to 40 μm, and can also produce innumerable linear concave portions or linear convex portions of several micrometers. In Embodiment 1, a sheet member having only thin lines of blade traces of about 5 μm produced thereon is used. The surface roughness Rz (JIS B0601) of the thin lines of blade traces of the sheet member was about 15 μm. The measurement was made using a surface roughness measuring instrument (SE-3400LK manufactured by Kosaka Laboratory Ltd.). In this embodiment, the depth of the concave portions or the depth of the convex portions is in the range of 5 μm or larger and 40 μm or smaller.

It is to be noted that, in Embodiment 1, an ultra high molecular weight conductive PE sheet is used as the sheet member, but a conductive PE sheet or a fluoroplastic sheet such as PFA, PTFA, or PVDF may also be used.

In FIGS. 2A and 2B, a physical nip A is a region in which the photosensitive drum 1*a* and the belt 80 abut against each other and the belt 80 and the primary transfer member 81*a* abut against each other. An upstream tension nip B on an upstream side of the physical nip A with respect to the movement direction of the belt is a region in which the photosensitive drum la and the belt 80 are not brought into contact with each other and the belt 80 and the primary transfer member 81*a* abut against each other. A downstream tension nip C on a downstream side of the physical nip A with respect to the movement direction of the belt is a region in which the photosensitive drum 1*a* and the belt 80 are not brought into contact with each other and the belt 80 and the primary transfer member 81*a* abut against each other.

The physical nip A between the photosensitive drum 1*a* and the intermediate transfer belt 80 was set to be 2.5 mm, the upstream tension nip B between the sheet member 32*a* and the intermediate transfer belt 80 was set to be 1 mm, and the downstream tension nip C between the sheet member 32*a* and the intermediate transfer belt 80 was set to be 1 mm. Further, a thickness D of the elastic member 31*a* is 5 mm. The primary transfer power supply circuit 84*a* connected to the primary transfer member 81*a* is connected to the sheet member 32*a*.

Next, action of the primary transfer portion according to Embodiment 1 is described.

As illustrated in FIGS. 2A and 2B, the primary transfer member 81*a* includes the elastic member 31*a* and the sheet member 32*a*, and presses the elastic member 31*a* and the sheet member 32*a* against the surface of the intermediate transfer belt 80 which is opposite to the surface bearing a toner image (hereinafter referred to as the inner surface of the intermediate transfer belt 80). Therefore, the elastic member 31*a* and the sheet member 32*a* can be made to be brought into contact with the inner surface of the intermediate transfer belt 80 without fail. By the action described above, uniform contact between the elastic member 31*a* and the sheet member 32*a* and the intermediate transfer belt 80 can be secured, and vertical thin line-like transfer failure due to contact unevenness in the longitudinal direction can be prevented.

By using the transfer member 81 having linear convex portions or concave portions on a surface thereof which is brought into contact with the inner surface of the belt 80, the friction co-efficient of the transfer member 81 with the intermediate transfer belt is decreased, and increase in the drive torque of the intermediate transfer belt can be suppressed.

It is to be noted that, here, the first image forming portion is described, but the second to fourth image forming portions are configured similarly to the first image forming portion, and thus, can provide effects which are similar to those of the first image forming portion.

<Evaluation of Embodiment>

In order to study the effects of the primary transfer portion according to Embodiment 1, an image forming apparatus having a process speed of 50 mm/sec was used to make evaluations with regard to the friction co-efficient of the sheet member, the drive torque of the belt, and the vertical thin line-like transfer failure due to contact unevenness in the longitudinal direction, utilizing comparative examples described in the following.

It is to be noted that, in the respective comparative examples described in the following, the first image forming portion is described, but the second to fourth image forming portions are configured similarly to the first image forming portion, and thus, description thereof is omitted.

<Comparative Example 1>

Figure 4A:
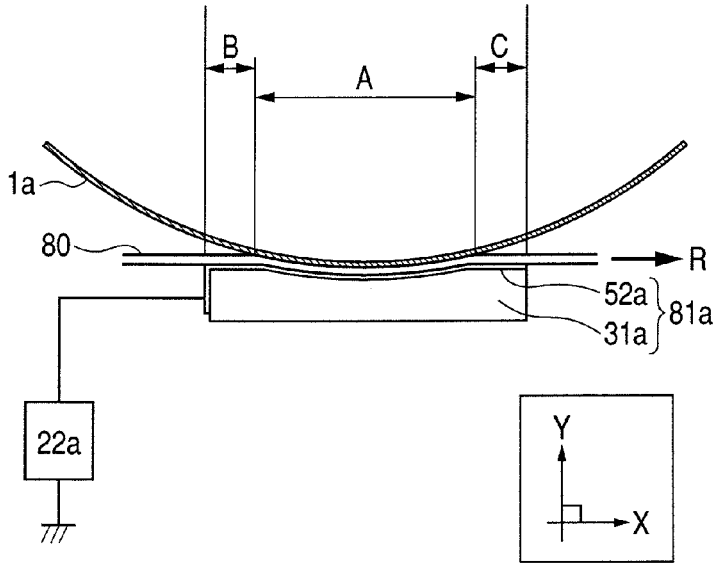
FIGS. 4A and 4B are explanatory views of a primary transfer portion used in Comparative Example 1.
Figure 4B:
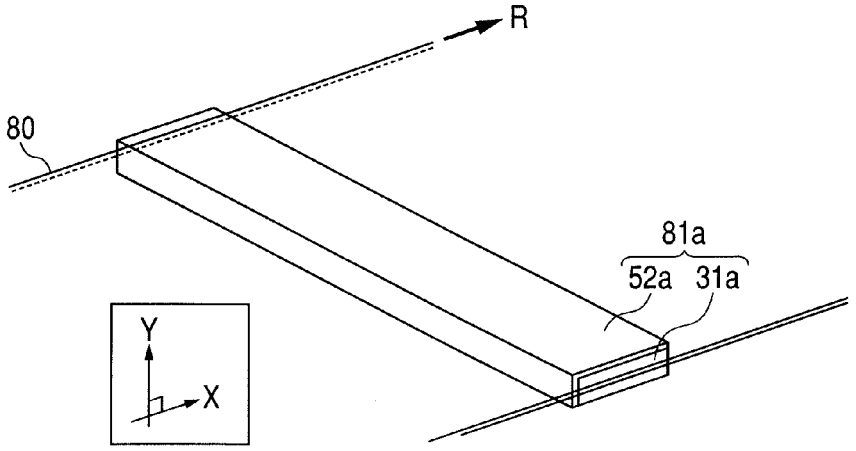

Comparative Example 1 is illustrated in FIGS. 4A and 4B, and a configuration thereof is described. As a sheet member 52*a*, a conductive PE sheet at a thickness of 100 μm is used. The method of manufacturing the conductive PE sheet is different from the method of manufacturing the sheet member used in Embodiment 1, and the member is extruded to be sheet-like. The sheet member 52*a* of Comparative Example 1 does not have thin lines of blade traces like those on the sheet member 32*a* in Embodiment 1, and the contact surface of the sheet member 52*a* with the intermediate transfer belt 80 is significantly smooth compared with the case of the sheet member 32*a* in Embodiment 1. The urging member 31*a* used in Comparative Example 1 is the same as that in Embodiment 1.

Figure 5A:
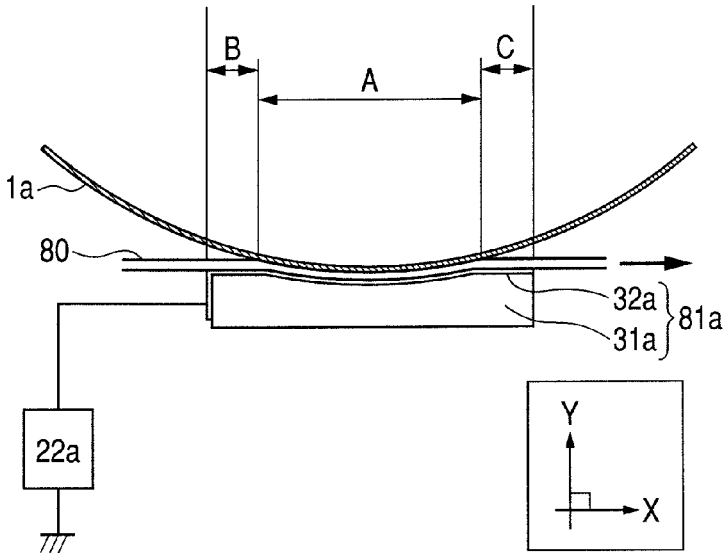
FIGS. 5A and 5B are explanatory views of a primary transfer portion used in Comparative Example 2.
Figure 5B:
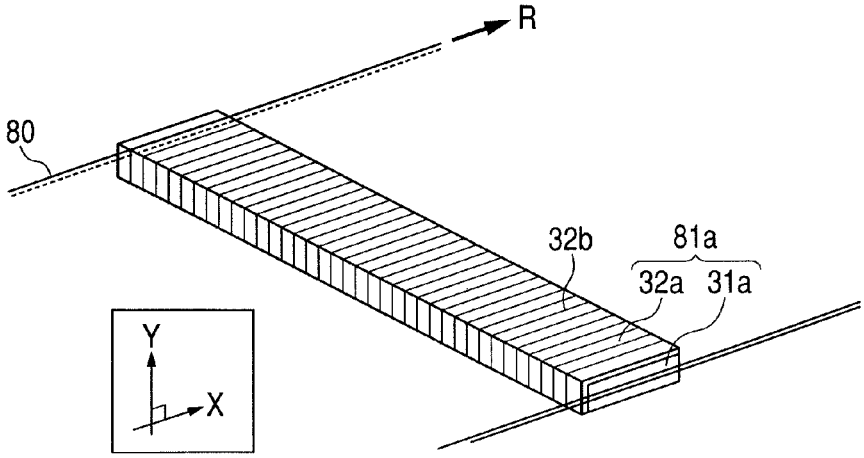

Comparative Example 2 is illustrated in FIGS. 5A and 5B, and a configuration thereof is described. The sheet member 32*a* similar to that in Embodiment 1 is used, and the sheet member 32*a* is disposed so that the direction of the thin lines of blade traces is the same as the conveyance direction of the belt. The urging member 31*a* used in Comparative Example 1 is the same as that in Embodiment 1.

The above-mentioned embodiment and comparative examples were used to measure the friction co-efficient of the surface of the sheet member which is brought into contact with the intermediate transfer belt and the drive torque of the intermediate transfer belt under the respective conditions, and evaluations were made. The results of the evaluations are illustrated in FIG. 6. The friction co-efficient as used herein is a value obtained when a portable tribometer (HEIDON TRIBOGER Muse Type 94i manufactured by SHINTO Scientific Co., Ltd.) was used.

In Embodiment 1, the friction co-efficient of the surface of the sheet member which was brought into contact with the intermediate transfer belt was 0.21, and the drive torque of the intermediate transfer belt was 0.14 [N·m].

In Comparative Example 1, the friction co-efficient of the surface of the sheet member which was brought into contact with the intermediate transfer belt was 0.4, and the drive torque of the intermediate transfer belt was 0.28 [N·m]. The obtained results were that performance thereof was inferior to that in Embodiment 1.

In Comparative Example 2, the friction co-efficient of the surface of the sheet member which was brought into contact with the intermediate transfer belt was 0.2, and the drive torque of the intermediate transfer belt was 0.14 [N·m]. Results equal to those of Embodiment 1 were obtained.

It was made clear that Embodiment 1 and Comparative Example 2 were effective in decreasing the friction co-efficient of the surface of the sheet member which was brought into contact with the intermediate transfer belt and in decreasing the drive torque of the intermediate transfer belt.

Then, evaluations were made with regard to the presence or absence of vertical thin lines which were image failure when the transfer current was changed from 1.0 μA to 5.0 μA in 1.0 μA steps. The results of the evaluations are illustrated in FIG. 7.

With regard to Comparative Example 1, the drive torque of the intermediate transfer belt was too high to be evaluated.

With regard to Comparative Example 2, when the transfer current was 1.0 μA and 2.0 μA, an image of minor vertical thin lines which were in parallel with the conveyance direction of the belt was formed. Locations in which the vertical thin lines were formed were coincident with the thin lines of blade traces on the surface of the sheet member. The surface roughness Rz (JIS) of the sheet member was about 15 μm, and it could be confirmed that the linear concave portions on the surface of the sheet member affect the image. It is thought that, the extent of discharge at the concave portions of the thin lines of blade traces on the sheet member differs from that at the convex portions, and hence nonuniform charge is caused in the longitudinal direction of the toner image which is primarily transferred onto the intermediate transfer belt.

From the results of Embodiment 1 and Comparative Example 1, Embodiment 1 had the thin lines of blade traces on the surface of the sheet member and the drive torque of the belt could be decreased. On the other hand, the surface of the sheet member used in Comparative Example 1 did not have the thin lines of blade traces, and the surface of the sheet member was significantly smooth compared with the case of the sheet member in Embodiment 1. Therefore, the drive torque of the intermediate transfer belt was high, and the intermediate transfer belt could not be moved. As a result, it could be confirmed that Embodiment 1 was effective in decreasing the drive torque of the intermediate transfer belt.

From the results of Embodiment 1 and Comparative Example 2, the thin lines of blade traces existed on the surface of the sheet member of Embodiment 1 and on the surface of the sheet member of Comparative Example 2, and the drive torque of the belt could be decreased. However, in Comparative Example 2, the vertical thin line-like transfer failure was caused due to the thin lines of blade traces in parallel with the conveyance direction of the belt. The transfer failure was caused when the transfer current was 1.0 μA and 2.0 μA. On the other hand, in Embodiment 1, only when the transfer current was 1.0 μA, vague vertical thin line-like transfer failure appeared to be observed. This is thought to be because the direction of the thin lines of blade traces on the sheet member of Comparative Example 2 was the same as the conveyance direction of the belt. When the direction of the thin lines of blade traces on the sheet member is the same as the conveyance direction of the belt, there are portions on the contact surface of the sheet member which are not brought into contact with the belt in the conveyance direction of the belt. The transfer efficiency of portions which are not brought into contact with the belt is lower than that of portions which are brought into contact with the belt, and hence, when the direction of the thin lines of blade traces on the sheet member is the same as the conveyance direction of the belt, the vertical thin line-like transfer failure is more liable to occur.

On the other hand, Embodiment 1 in which the direction of the thin lines of blade traces on the sheet member intersected the conveyance direction of the belt was confirmed to be effective in suppressing the vertical thin line-like transfer failure. More specifically, in Embodiment 1, the vertical thin line-like transfer failure due to unevenness at the thin lines of blade traces was minor, and the range of a current to be generated was narrower than that of the comparative examples. Therefore, it can be said that Embodiment 1 is a configuration which can be used in a wide application.

From the results of Embodiment 1, Comparative Example 1, and Comparative Example 2, the configuration of Embodiment 1 could secure uniform contact between the sheet member and the intermediate transfer belt, and suppress vertical thin line-like image failure. Further, by making the thin lines of blade traces on the surface of the sheet member in Embodiment 1 intersect the conveyance direction of the belt (here, obliquely so as to form an angle of 30°), the vertical thin line-like transfer failure due to unevenness at the thin lines of blade traces could also be suppressed. Further, by using the sheet member having the thin lines of blade traces which were produced in the manufacturing process, increase in drive torque of the intermediate transfer belt could be effectively suppressed.

It is to be noted that, in Embodiment 1, the thin lines of blade traces on the sheet member are disposed so as to intersect obliquely the conveyance direction of the belt and to form an angle of 30°, but insofar as the two intersect each other, even if the degree is of another value, similar effects can be obtained. By making the thin lines of blade traces on the sheet member intersect the conveyance direction of the intermediate transfer belt so as to form a larger angle, the linear concave portions or the linear convex portions formed by the thin lines of blade traces on the surface of the sheet member can suppress more effectively the vertical thin line-like transfer failure.

Figure 8A:
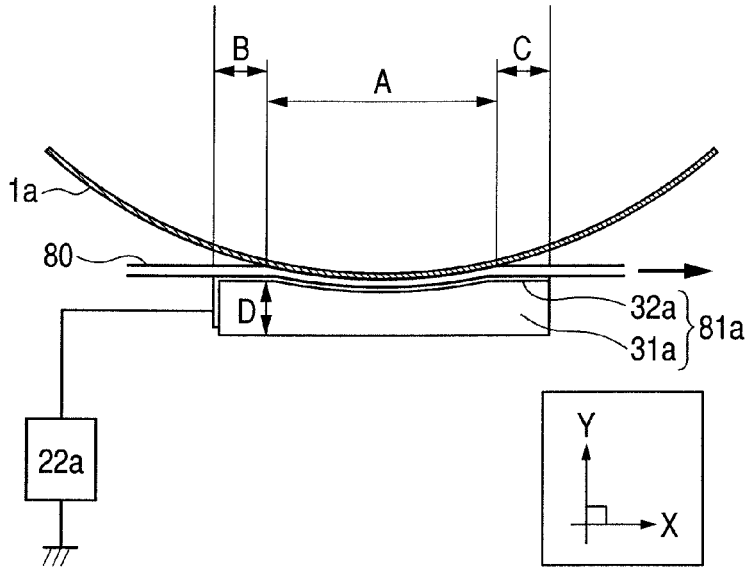
FIGS. 8A and 8B are explanatory views of still another configuration of the primary transfer portion used in Embodiment 1.
Figure 8B:
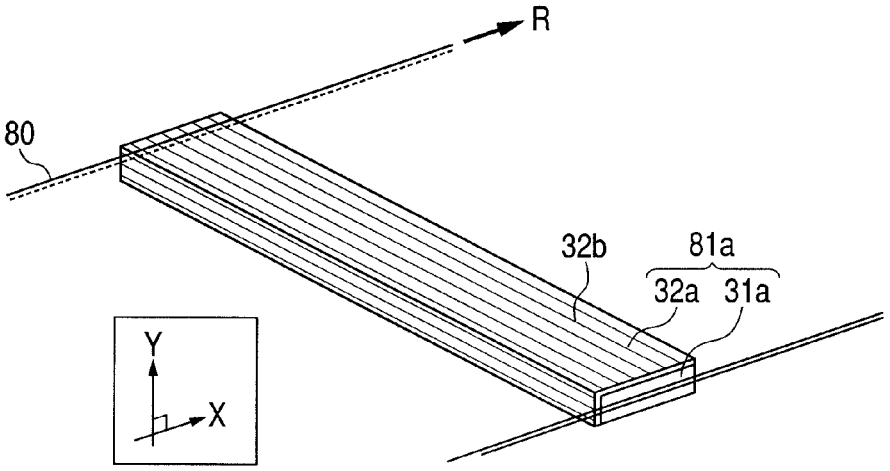

For example, as illustrated in FIGS. 8A and 8B, the linear convex portions 32*b* on the surface of the sheet member 32*a* may be made to be orthogonal to the conveyance direction of the belt (in the direction illustrated by the arrow R). It is to be noted that FIG. 8B schematically illustrates the convex portions for the sake of easy understanding of the convex portions. Further, there is a concave portion between convex portions.

In the configuration illustrated in FIGS. 8A and 8B, with regard to all values of the transfer current, the vertical thin line-like image failure substantially did not occur. The thin lines of blade traces were disposed orthogonally to the conveyance direction of the intermediate transfer belt, and hence an image could be formed with no effects of the nonuniformity at the thin lines of blade traces on the sheet member in the longitudinal direction of the primary transfer portion. It is thought that, because a discharge phenomenon caused at the primary transfer portion could be made uniform in the longitudinal direction without being affected by the nonuniformity on the surface of the sheet member, the effects described above could be obtained.

<Embodiment 2>

Figure 9:
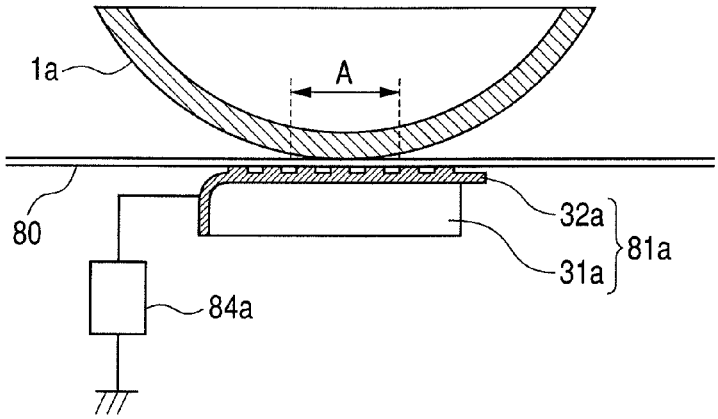
FIG. 9 is a partial sectional view illustrating a configuration of a primary transfer portion according to Embodiment 2.

Next, a configuration of a primary transfer portion according to Embodiment 2 is described with reference to FIG. 9. It is to be noted that the configuration of the image forming apparatus applied to this embodiment is similar to that of Embodiment 1 described above except for the shape of the transfer member (sheet member). Like numerals and symbols are used to denote like or identical members and description thereof is omitted. FIG. 9 is an enlarged sectional view of each primary transfer region. Here, the primary transfer region of the first image forming station is illustrated, but the primary transfer regions of the second to fourth image forming stations are similarly configured.

As illustrated in FIG. 9, the primary transfer member 81*a* includes the elastic member 31*a* and the sheet member 32*a*. The sheet member 32*a* is sandwiched between the intermediate transfer belt 80 and the elastic member 31*a*, and is urged by the elastic member 31*a* toward the inner surface of the intermediate transfer belt 80 and is brought into contact with the belt 80. A multiple concave portions and convex portions are provided on the contact surface of the sheet member 32*a* with the intermediate transfer belt 80 (contact region A). This embodiment does not have linear concave portions and convex portions as in Embodiment 1, but has multiple concave portions and convex portions provided adjacently to one another.

Figure 10A:
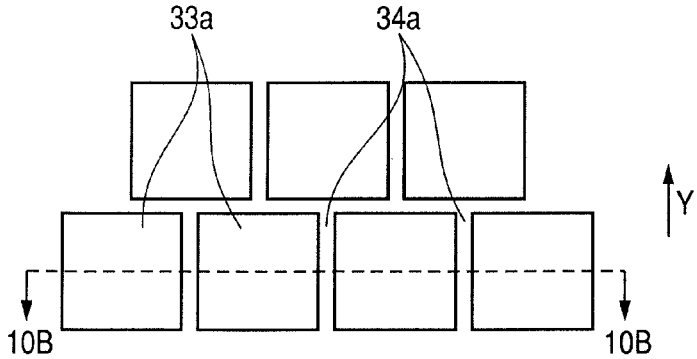
FIGS. 10A and 10B are explanatory views illustrating a shape of a primary transfer member according to Embodiment 2.
Figure 10B:
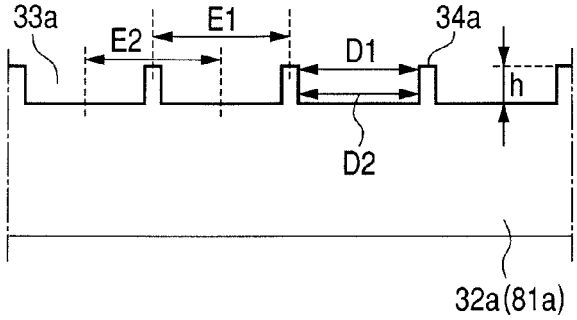

As illustrated in FIGS. 10A and 10B, nonuniformity provided on the sheet member 32*a* of the primary transfer member 81*a* is multiple concave portions 33*a* and convex portions 34*a* provided adjacent to one another. FIG. 10A is a plan view of the sheet member and FIG. 10B is a sectional view taken along the line 10B-10B of FIG. 10A. In FIG. 10A, Y denotes a movement direction of the belt. With regard to the nonuniformity on the surface of the sheet member 32*a*, a width D1 between the tops of the square convex portions 34*a* is 60 μm and a width D2 at the bottom of each of the square concave portions 33*a* (maximum width of the bottom) is 60 μm. A pitch E1 between the convex portions 34*a* is 80 μm while a pitch E2 between the concave portions 33*a* is 80 μm. A depth h of the concave portions 33*a* is a perpendicular distance between the top of the convex portions 34*a* and the bottom of the concave portions 33*a*. The concave portions 33*a* and the convex portions 34*a* on the sheet member 32*a* are disposed with respect to the movement direction of the intermediate transfer belt 80 (the direction of the arrow Y). The nonuniformity (concave portions 33*a*) is discontinuously disposed with respect to the movement direction of the intermediate transfer belt (the direction of the arrow Y). Further, a width of the contact region A of the sheet member 32*a* with the intermediate transfer belt 80 is 3 mm. In this way, in the movement direction of the intermediate transfer belt 80, the maximum width D2 of the bottom of the concave portion 33*a* is set to be smaller than the width of the contact region A between the intermediate transfer belt 80 and the sheet member 32*a*.

Similarly to the case of Embodiment 1, in the primary transfer member 81*a*, as the elastic member 31*a*, a polyurethane foamed sponge-like elastic body substantially in the shape of a rectangular parallelepiped having a thickness of 2 mm, a width of 5 mm, and a length of 230 mm is used. The elastic member 31*a* is 30° ASKER C hardness at a load of 500 gf. It is to be noted that, here, foamed polyurethane is used as the elastic member 31*a*, but the present invention is not limited thereto and, for example, a rubber material such as epichlorohydrin rubber, NBR, or EPDM may also be used.

Similarly to the case of Embodiment 1, as the sheet member 32*a*, a polyamide (PA) resin having a volume resistivity of 1E6 Ω cm when a voltage of 100 V is applied thereto and a thickness of 200 μm is used, and carbon is dispersed therein as a conductor so that the electrical resistance is set to be $10^8$Ω. It is to be noted that, here, a vinyl acetate sheet is used as the sheet member 32*a*, but the present invention is not limited thereto, and other materials such as a vinyl acetate sheet, polycarbonate (PC), PVDF, PET, polyimide (PI), and polyethylene (PE) may also be used.

Further, in this embodiment, as the method of forming nonuniformity on the contact surface of the sheet member 32*a*, a mold roll (not shown) having nonuniformity formed on the surface thereof by photoetching was used to heat and press the surface of the sheet member 32*a*. However, the method of forming the above-mentioned nonuniformity is not limited thereto, and other methods may also be used insofar as similar nonuniformity can be formed thereby on the surface of the sheet member (the contact surface with the inner surface of the belt 80).

Action and effects of Embodiment 2 are described in the following.

In a configuration in which a transfer current passes between the primary transfer member 81*a* and the intermediate transfer belt 80, in addition to normal force by being urged by the elastic member 31*a*, electrostatic attraction between the transfer member 81*a* and the intermediate transfer belt 80 (hereinafter referred to as adsorptive force) acts on the sheet member 32*a*.

According to a study by the inventors of the present invention, it was made clear that, because the surface of the transfer member 81*a* brought into contact with the inner surface of the belt had the multiple concave portions and convex portions, increase in the above-mentioned adsorptive force and drive torque of the intermediate transfer belt 80 could be greatly suppressed. This is because electrostatic adsorptive force which acts between the transfer member 81*a* and the intermediate transfer belt 80 becomes larger in proportion to ½ power of the average surface-surface distance (space) between the two. This embodiment is different from Embodiment 1 in that the concave portions and the convex portions on the sheet member 32*a* are disposed in the conveyance direction of the intermediate transfer belt 80 (in a direction illustrated by an arrow Y). The concave portions and the convex portions on the sheet member 32*a* are disposed in the conveyance direction of the intermediate transfer belt 80 (in the direction illustrated by the arrow Y), and hence a state in which portions of the sheet member 32*a* which are not brought into contact with the belt are disposed in a line along the conveyance direction of the belt can be prevented.

Figure 11A:
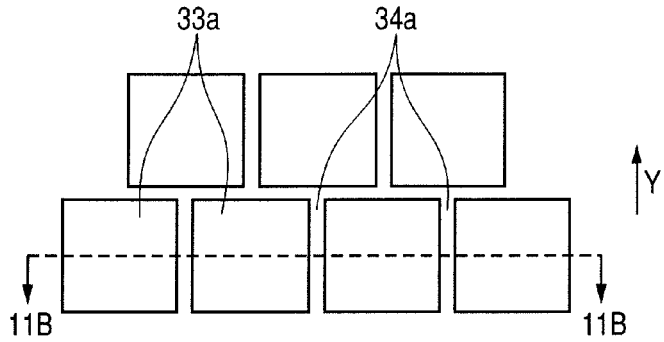
FIGS. 11A and 11B are explanatory views of a comparative example of Embodiment 1.
Figure 11B:
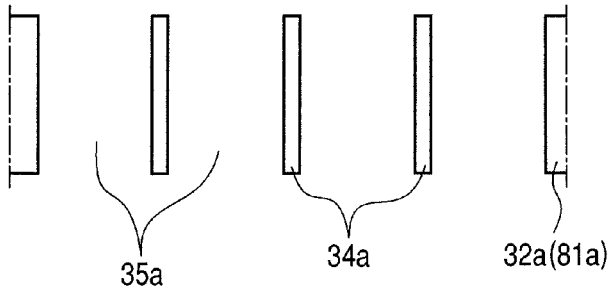

Further, in the concave portions 33*a* of the nonuniformity on the primary transfer member 81*a*, electric discharge toward the surface of the intermediate transfer belt 80 is caused to decrease the amount of charge on the whole transfer member 81*a*, and hence the amount of discharge to the intermediate transfer belt 80 becomes stable to greatly contribute to charging of the intermediate transfer belt 80. It is to be noted that, as illustrated in FIGS. 11A and 11B, instead of the concave portions 33*a* which are not through holes, numerous through holes 35*a* formed in the primary transfer member 81*a* may also attain decrease in the adsorptive force. However, the through holes 35*a* do not cause the electric discharge as described above, and thus, are not optimum as the transfer member.

<Evaluation of Embodiment 2>

As an abbreviated method of evaluating the effect of decreasing friction force and adsorptive force which act between the transfer member 81*a* and the intermediate transfer belt 80 of this embodiment, the following was carried out.

Figure 12:
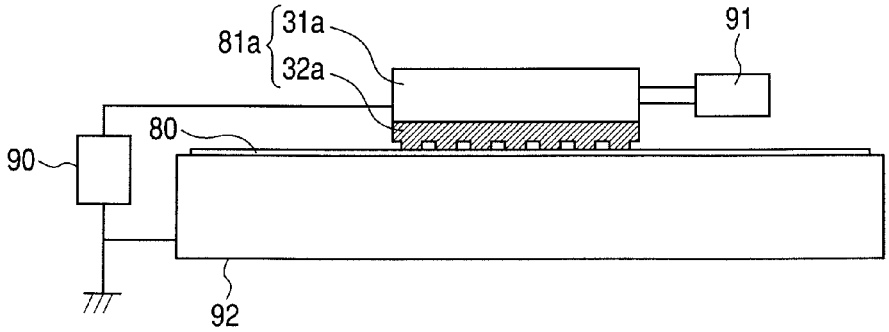
FIG. 12 is an explanatory view of a method of evaluating Embodiment 2 and Comparative Example 3.

As illustrated in FIG. 12, the intermediate transfer belt 80 was stuck on a support 92 which is grounded so that there is no gap therebetween, and the transfer member 81*a* is disposed thereon so that the sheet member 32*a* is brought into contact with the surface of the intermediate transfer belt 80. Further, the transfer member 81*a* is pressed against the intermediate transfer belt 80 with pressure which correspond to that applied in the image forming apparatus. The transfer member 81*a* is disposed so that an arbitrary voltage is applied thereto by an external power supply device 90. Further, a digital force gauge 91 is attached to the transfer member 81*a* so that, when the transfer member 81*a* horizontally moves on the intermediate transfer belt 80, the friction load (friction force) which acts between the transfer member 81*a* and the intermediate transfer belt 80 can be measured. It is to be noted that the velocity of the moving transfer member 81*a* was 10 mm/sec.

This measuring method was used to measure the friction load with regard to transfer members in which the depth h between the bottom of the concave portions and the top of the convex portions was 5 μm, 4 μm, and 2 μm, respectively, and a transfer member in a different shape as described below (Comparative Example 3).

In Comparative Example 3, as the sheet member 32*a*, a sheet member which is formed of a polyamide (PA) resin and the surface of which is smooth is used. The center line average roughness Ra of a surface of the sheet member 32*a* which is brought into contact with the intermediate transfer belt 80 is 0.2 to 0.3 μm, and the sheet member 32 is substantially smooth. Further, carbon is dispersed in the sheet member of Comparative Example 3 as a conductor so that the electrical resistance is set to be $10^8\Omega$. In the conveyance direction of the belt, the contact region between the sheet member 32*a* and the intermediate transfer belt 80 (nip width) is 3 mm. The elastic member 31*a* and the intermediate transfer belt 80 used in Comparative Example 3 are the same as those in Embodiment 2.

<Results of Evaluation>

Figure 13:
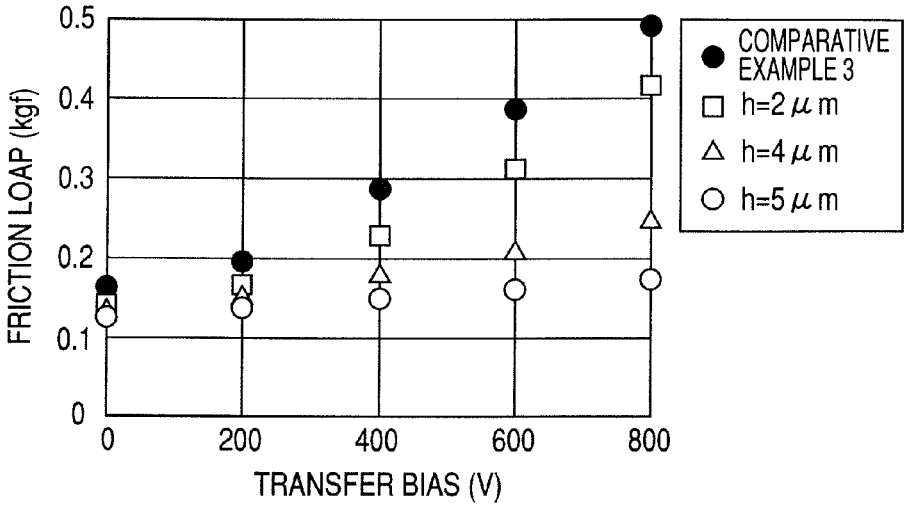
FIG. 13 is a graph illustrating results of evaluations of Embodiment 2 and Comparative Example 3.

The results of the evaluations are illustrated in FIG. 13. The tensile load of each of the transfer members was measured when the voltage applied to the transfer member 81*a* was changed from 0 to 800 V in 200 V steps.

The tensile load when the applied bias was 0 V was the friction load when normal force by being pressed was applied. By applying the bias, friction load due to the adsorptive force between the transfer member 81*a* and the intermediate transfer belt 80 was added.

In the configuration in which h=5 μm, with regard to each of the biases applied, the friction load between the transfer member 81*a* and the intermediate transfer belt 80 was not greatly increased, and it can be said that the adsorptive force was substantially stable and low.

Compared with the case of the configuration in which h=5 μm, in the configuration of Comparative Example 3, as the applied voltage becomes higher, the friction load between the transfer member 81*a* and the intermediate transfer belt 80 was quadratically increased and the adsorptive force was abruptly increased.

Further, as illustrated in FIG. 13, in the configurations in which h=4 μm and h=2 μm, the obtained result was that, as the depth of the nonuniformity became larger, the increase in the friction load between the transfer member 81*a* and the intermediate transfer belt 80, that is, the adsorptive force, could be suppressed. However, when the depth of the nonuniformity was 4 μm or smaller, the effect of the suppression was not so great as that in Embodiment 2. According to study by the inventors of the present invention, it was made clear that the optimum depth h of the nonuniformity for obtaining the effect of suppressing the friction load and the adsorptive force between the transfer member 81*a* and the intermediate transfer belt 80 was desirably 5 μm or larger. More specifically, when the depth between the bottom of the concave portions and the top of the convex portions is 5 μm or larger and 40 μm or smaller, the effect of suppressing the friction load and the adsorptive force is greater.

Further, the transfer member of Embodiment 2 was used to conduct a continuous paper-passing test with regard to the above-mentioned image forming apparatus. The result was that the endurance life was about 1.5 to 2.0 times as long as that in the case of a configuration in which a conventional transfer member was used. It is to be noted that, in the above-mentioned evaluations, the primary transfer portion of the first image forming station has been described by way of example, but the second to fourth image forming stations are configured similarly to the first image forming station, and thus, similar effects are obtained.

As described above, according to this embodiment, by forming the nonuniformity on the contact surface of the transfer member 81 with the intermediate transfer belt 80 (contact region A), the increase in the friction force between the intermediate transfer belt 80 and the transfer member 81 can be suppressed. This makes it possible to suppress unusual noise generated between the intermediate transfer belt 80 and the transfer member 81 due to increase in the drive torque of the intermediate transfer belt 80 and to prevent image failure such as transfer failure. Further, the transfer member 81 is brought into contact with the intermediate transfer belt 80 with stability, and hence stable transfer performance can be maintained and image failure such as transfer failure can be prevented.

<Embodiment 3>

Embodiment 3 of the present invention is now described with reference to the drawings. It is to be noted that the configuration of the image forming apparatus applied to this embodiment is similar to that of Embodiment 2 described above except for the shape of the transfer member (sheet member). Like numerals are used to designate like or identical members and description thereof is omitted. The shape of the sheet member of the transfer member used in Embodiment 3 is described in the following with reference to FIG. 16.

Figure 14A:
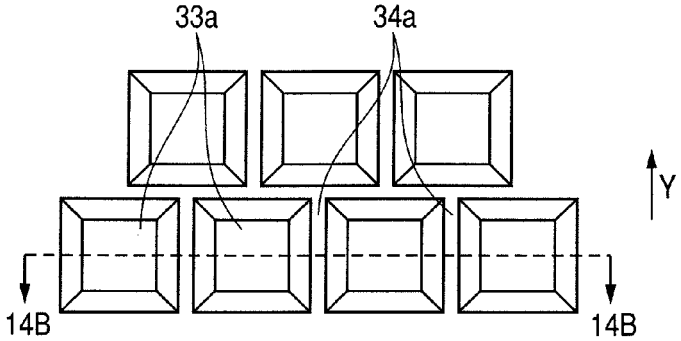
FIGS. 14A and 14B are explanatory views of a shape of a primary transfer member according to Embodiment 3.
Figure 14B:
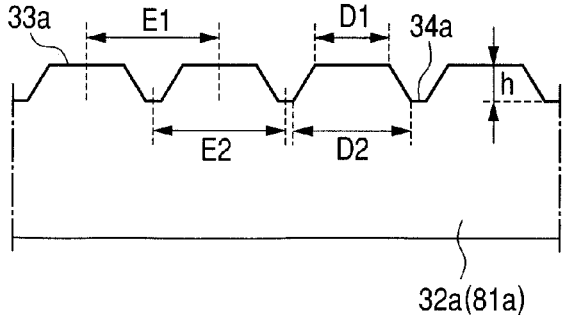
Figure 16:
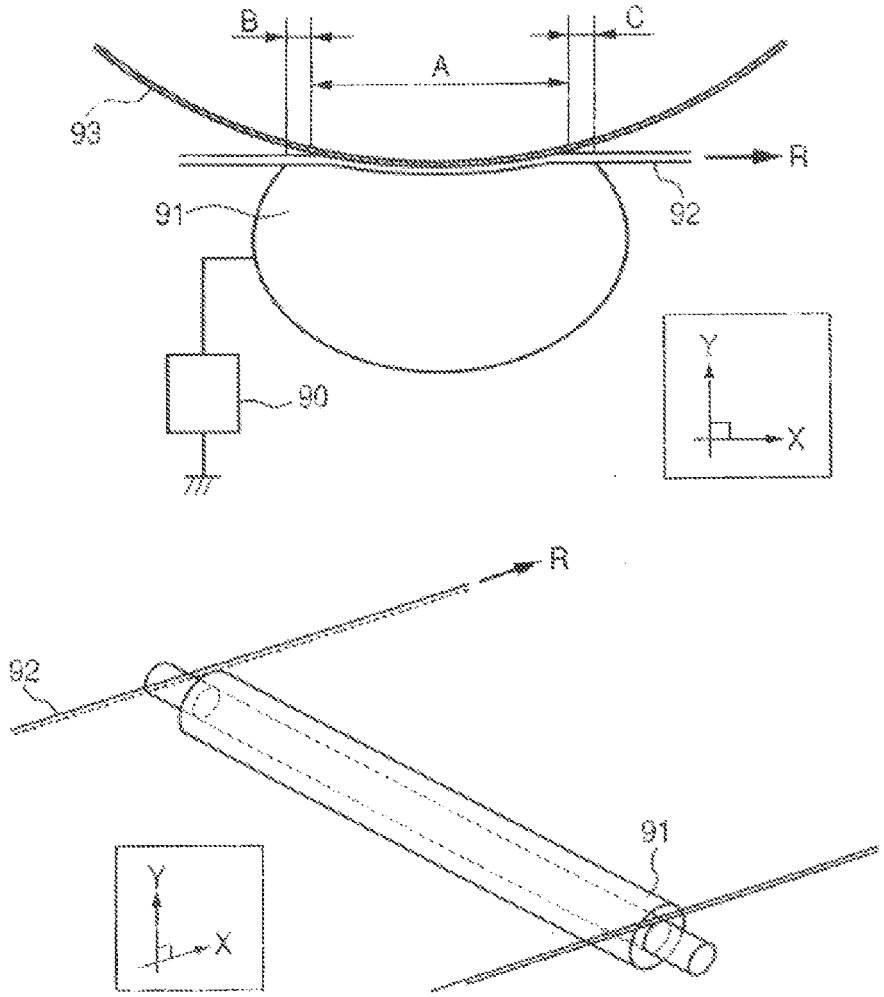
FIG. 16 illustrates a configuration of a transfer portion using a conventional transfer roller.

As illustrated in FIGS. 14A and 14B, nonuniformity provided on the sheet member 32*a* of the primary transfer member 81*a* is multiple concave portions 33*a* and convex portions 34*a* provided adjacently to one another. FIG. 14A is a top view of the sheet member and FIG. 14B is a sectional view taken along the line 14B-14B of FIG. 14A. In FIG. 16, Y denotes the conveyance direction of the belt. The sheet member 32*a* of Embodiment 3 is different from the sheet member 32*a* of Embodiment 2 in that each of the convex portions and the concave portions has inclined surfaces 36. More specifically, with regard to the nonuniformity on the surface of the sheet member 32*a* according to this embodiment, a width D1 at the top of each of the square convex portions 34*a* is 60 μm, a width D2 at the bottom of each of the square convex portions is 100 μm, and the side surfaces are the inclined surfaces. More specifically, the nonuniformity on the surface of the sheet member 32*a* includes the inclined surfaces 36 between the top of each of the convex portions 34*a* and the bottom of each of the concave portions 33*a*. The inclined surfaces 36 tilt from the top of each of the convex portions 34*a* toward the bottom of each of the concave portions 33*a*. A pitch E1 between the convex portions 34*a* is 120 μm while a pitch E2 between the concave portions 33*a* is 120 μm. Further, the depth h of the concave portions 33*a* is 50 μm. The depth h of the concave portions 33*a* is a perpendicular distance between the top of the convex portions 34*a* and the bottom of the concave portions 33*a*. Further, the nonuniformity on the sheet member 32*a* (convex portions 34*a*) is discontinuously disposed with respect to the conveyance direction of the intermediate transfer belt 80 (the direction of the arrow Y). The width of the contact region A of the sheet member 32*a* with the intermediate transfer belt 80 is 3 mm. In this way, in the conveyance direction of the intermediate transfer belt 80, the maximum width of the bottom of the concave portion 33*a* between the convex portions 34*a* is set to be smaller than the width of the contact region A between the intermediate transfer belt 80 and the sheet member 32*a*.

Action and effects of Embodiment 3 are described in the following.

In a configuration in which transfer current passes between the primary transfer member 81*a* and the intermediate transfer belt 80, in addition to normal force by being pressed by the elastic member 31*a*, electrostatic attraction between the transfer member 81*a* and the intermediate transfer belt 80 (hereinafter, referred to as adsorptive force) acts on the sheet member 32*a*.

As described above, by forming the nonuniformity on the surface of the transfer member 81*a* (the contact surface with the belt), increase in the above-mentioned adsorptive force and drive torque of the intermediate transfer belt 80 can be greatly suppressed. Further, in the concave portions 33*a* of the nonuniformity on the transfer member 81*a*, electric discharge toward the surface of the intermediate transfer belt 80 is caused to decrease the amount of charge on the whole transfer member 81*a*, and hence the amount of discharge to the intermediate transfer belt 80 becomes stable to greatly contribute to charging of the intermediate transfer belt 80. Further, by forming the inclined surfaces between the bottom of each of the concave portions and the top of each of the convex portions adjacent to one another, the inclined surfaces inclined from the bottom of each of the concave portions toward the top of each of the convex portions, abnormal discharge due to a large gap between the concave portions and the convex portions can be prevented, and more stable transfer performance can be maintained.

<Other Embodiments>

As described above, as the nonuniformity on the sheet member 32*a*, in Embodiment 2, as illustrated in FIGS. 10A and 10B, the configuration in which the concave portions 33*a* and the convex portions 34*a* are disposed in the conveyance direction of the intermediate transfer belt is described by way of example. In Embodiment 3, as illustrated in FIG. 16, the configuration in which the convex portions 34*a* are discontinuously disposed is described by way of example. Further, the configuration in which the convex portions 34*a* of Embodiment 3 includes the inclined surfaces inclined from the top toward the bottom is described by way of example. However, the configuration may also be such that the concave portions 33*a* of Embodiment 2 includes inclined surfaces inclined from the bottom toward the top. Such a configuration enables, similarly, maintaining more stable transfer performance.

Further, in the embodiments described above, four image forming stations are used, but the number of the image forming stations used is not limited thereto, and may be appropriately set as necessary.

Further, in the embodiments described above, as a process cartridge detachably attached to the main body of the image forming apparatus, a process cartridge in which a photosensitive drum and charge device, developing means, and cleaning means as process means for acting on the photosensitive drum are integrally provided is described by way of example, but the process cartridge is not limited thereto. For example, the process cartridge may be a process cartridge which has, in addition to the photosensitive drum, any one of charge device, developing means, and cleaning means integrally provided therein.

Further, in the embodiments described above, the configuration in which the process cartridges including the photosensitive drums are detachably attached to the main body of the image forming apparatus is illustrated, but the present invention is not limited thereto. For example, the image forming apparatus may have photosensitive drums and process means incorporated therein, or the image forming apparatus may have photosensitive drums and process means which are respectively detachably attached thereto.

Still further, in the embodiments described above, a printer is described by way of example as the image forming apparatus, but the present invention is not limited thereto. For example, the image forming apparatus may be other image forming apparatus such as a copying machine and a facsimile machine, or other image forming apparatus such as a complex machine having a combination of the functions of the aforementioned image forming apparatus. Further, the belt which can carry out conveyance is not limited to an intermediate transferring member, and the image forming apparatus may use a recording material bearing member for bearing and conveying a recording material and may transfer toner images of the respective colors overlaid on one another in succession on a recording material borne by the recording material bearing member. By applying the present invention to those image forming apparatus, similar effects can be obtained.

Figure 15:
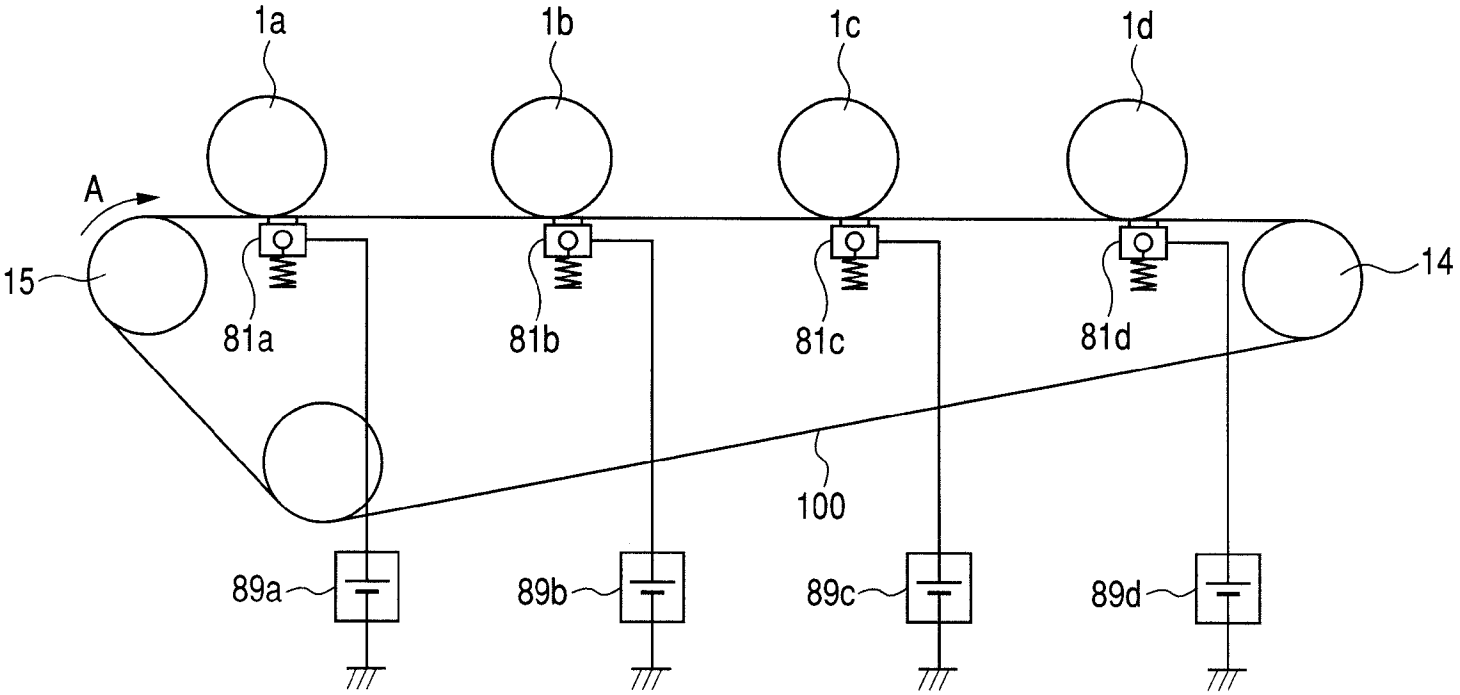
FIG. 15 illustrates an image forming apparatus according to another embodiment of the present invention.

As illustrated in FIG. 15, the image forming apparatus may be an image forming apparatus which uses a recording material conveyor belt 100 as an endless belt for bearing and conveying a recording material and which transfers toner images of the respective colors overlaid on one another in succession on a recording material S borne by the belt 100. The primary transfer members of the embodiments described above may be used as transfer members 81*a*, 81*b*, 81*c*, and 81*d* of FIG. 15.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-299055 filed on Nov. 19, 2007, No. 2008-045517 filed on Feb. 27, 2008, and No. 2008-294169 filed on Nov. 18, 2008, which are hereby incorporated by reference herein in their entirety.

What is claimed is:

1. An image forming apparatus comprising;

an image bearing member that is capable of bearing a toner image, a belt that is movable in a moving direction, which is configured to convey a recording material on which a toner image is transferred, or on which a toner image is directly transferred;

a transfer device including a contact member that contacts the belt and a support member that supports the contact member; and a power supply that is capable of supplying a voltage to the transfer device, wherein the transfer device to which a voltage is applied transfers a toner image from the image bearing member to the belt or a recording material conveyed by the belt, wherein the contact member does not move with respect to the belt in a direction perpendicular to a moving direction of the belt in a case where a toner image is transferred to the belt and the contact member contacts the belt without rotating with respect to the support member while the belt moves, wherein the contact member includes a plurality of contact portions in contact with the belt and a plurality of non-contact portions not in contact with the belt, wherein as viewed from a moving direction of the belt to the contact member, at least one of the plurality of contact portions is at any portion in a direction perpendicular to the moving direction of the belt.

2. An image forming apparatus according to claim 1, wherein the contact member is a sheet member.

3. An image forming apparatus according to claim 2, wherein the support member is an elastic member.

4. An image forming apparatus according to claim 2, wherein the power supply supplies a voltage to the sheet member.

5. An image forming apparatus according to claim 4, wherein the sheet member is electrically adhered to the belt.

6. An image forming apparatus according to claim 1, wherein each contact portion respectively adjoins at least one non-contact portion.

7. An image forming apparatus according to claim 6, wherein a height difference between at least one of the plurality of contact portions and adjoining one of the plurality of non-contact portions is in a range of 5 μm or larger and 40 μm or smaller.

8. An image forming apparatus according to claim 1, wherein at least one inclined surface is provided between a top of at least one of the plurality of non-contact portions and a bottom of at least one of the plurality of contact portions adjoining one of the plurality of non-contact portions, and wherein the inclined surface inclines towards the bottom of each of the at least one of the plurality of non-contact portions from the top of each of the at least one of the plurality of contact portions.

9. An image forming apparatus according to claim 1, wherein a plurality of non-contact portions is provided not continuously in the moving direction of the belt.

* * * * *